US007946304B2

(12) United States Patent
Kim et al.

(10) Patent No.: US 7,946,304 B2
(45) Date of Patent: May 24, 2011

(54) DISH WASHING MACHINE HAVING SUMP WITH DRAINAGE CHANNEL TO REMOVE WASH WATER

(75) Inventors: Eui Soo Kim, Suweon-si (KR); Yong Woon Han, Gunpo-si (KR); Young Ho Kwon, Seognam-si (KR); Shimotera Kennichi, Seoul (KR); Sung Jin Kim, Suweon-si (KR); Jung Chan Ryu, Suwon-si (KR); Jae Young Choi, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 590 days.

(21) Appl. No.: 11/806,519

(22) Filed: May 31, 2007

(65) Prior Publication Data

US 2008/0011335 A1 Jan. 17, 2008

(30) Foreign Application Priority Data

Jul. 12, 2006 (KR) ..... 10-2006-0065595

(51) Int. Cl.

| | |
|---|---|
| ***B08B 3/00*** | (2006.01) |
| ***B08B 3/12*** | (2006.01) |
| ***B08B 6/00*** | (2006.01) |
| *B08B 3/04* | (2006.01) |

(52) U.S. Cl. ..... 134/186; 134/56 D; 134/57 D; 134/58 D; 134/104.2; 134/104.4; 134/182; 134/184

(58) Field of Classification Search ..... 134/104.2, 134/56 D, 57 D, 58 D, 104.4, 182, 184, 186
See application file for complete search history.

(56) References Cited

U.S. PATENT DOCUMENTS

| | | | | |
|---|---|---|---|---|
| 5,143,306 | A * | 9/1992 | Nilsson | 241/46.012 |
| 5,450,868 | A * | 9/1995 | Young, Jr. | 134/111 |
| 5,586,567 | A * | 12/1996 | Smith et al. | 134/57 D |
| 5,837,151 | A * | 11/1998 | Jozwiak | 210/787 |
| 2005/0120533 | A1 * | 6/2005 | Yoon et al. | 29/428 |
| 2005/0133072 | A1 * | 6/2005 | Yoon et al. | 134/58 D |
| 2005/0268948 | A1 * | 12/2005 | Jeong | 134/104.4 |
| 2005/0284505 | A1 * | 12/2005 | Bang | 134/56 D |
| 2006/0118147 | A1 * | 6/2006 | Jeong et al. | 134/58 D |

FOREIGN PATENT DOCUMENTS

| | | |
|---|---|---|
| CN | 1628597 | 6/2005 |
| CN | 1778256 | 5/2006 |
| KR | 10-2006-0027096 | 3/2006 |
| KR | 10-2005-0054699 | 6/2006 |

OTHER PUBLICATIONS

Chinese Office Action for corresponding Chinese Application 200710110059.6; issued on Jan. 16, 2009.

* cited by examiner

*Primary Examiner* — Michael Barr
*Assistant Examiner* — Charles W Kling
(74) *Attorney, Agent, or Firm* — Staas & Halsey LLP

(57) ABSTRACT

A dish washing machine capable of smoothly discharging dirt contained in wash water out of a sump so as to prevent the emission of bad smells from the dirt and prevent the propagation of bacteria. The dish washing machine includes a sump to receive and pump wash water, a sump housing forming an external appearance of the sump, a drainage pump coupled with the sump housing to discharge wash water and dirt, and a drainage channel disposed in the sump housing to guide wash water and dirt to the drainage pump.

8 Claims, 12 Drawing Sheets

DISH WASHING MACHINE HAVING SUMP WITH DRAINAGE CHANNEL TO REMOVE WASH WATER

CROSS-REFERENCE TO RELATED APPLICATIONS

This application claims the benefit of Korean Patent Application No. 10-2006-0065595, filed on Jul. 12, 2006 in the Korean Intellectual Property Office, the disclosure of which is incorporated herein by reference.

BACKGROUND OF THE INVENTION

1. Field of the Invention

The present invention relates to a dish washing machine. More particularly, to a dish washing machine capable of improving spatial utilization of a washing tub through the enlargement of the washing tub and controlling the amount of wash water based on the quantity of dishes at the time of washing the dishes.

2. Description of the Related Art

A conventional dish washing machine is a machine that automatically washes dishes using cold water or hot water. A conventional dish washing machine includes a machine body, a washing tub formed in the machine body, baskets mounted in the washing tub, and main, middle, and sub nozzles mounted at the upper part, the middle part, and the lower part of the washing tub to inject wash water, which is disclosed in Korean Unexamined Patent Publication No. 2006-27096.

At the bottom of the washing tub is mounted a sump to receive wash water and pump the wash water to the respective nozzles. The sump includes a sump housing forming the external appearance of the sump, a heater mounted in the sump housing, a washing impeller disposed in the sump housing to pump wash water, a channel to guide the wash water pumped from the washing impeller to the respective nozzles, a channel control valve mounted in the channel to control the flow of wash water, and a pump motor mounted at the outside of the sump housing to drive the washing impeller.

In the sump housing is disposed a heater receiving part, which is formed in the shape of a square pool. The heater is received in the heater receiving part. At the outside of the sump housing is disposed a drainage pump, which communicates with the heater receiving part.

When dirt mixed with wash water is left in the heater receiving part, the drainage pump is operated such that the dirt and the wash water are discharged to the outside. However, the bottom of the heater receiving part is flat, and the dirt is caught by the heater. As a result, it is difficult to completely discharge the dirt.

When dirt is left in the heater receiving part due to the structural problems of the heater and the heater receiving part, bad smells are emitted from the dirt and bacteria propagate, which are great sanitary problems.

SUMMARY OF THE INVENTION

Accordingly, it is an aspect of the present invention to provide a dish washing machine capable of smoothly discharging wash water and dirt contained in the wash water so as to prevent an emission of bad smells from the dirt or the wash water and to prevent the propagation of bacteria.

Additional aspects and/or advantages of the invention will be set forth in part in the description which follows and, in part, will be apparent from the description, or may be learned by practice of the invention.

The foregoing and/or other aspects of the present invention are achieved by providing a dish washing machine including a sump to receive and pump wash water, a sump housing forming an external appearance of the sump, a drainage pump coupled with the sump housing to discharge wash water and dirt, and a drainage channel disposed in the sump housing to guide wash water and dirt to the drainage pump.

According to an aspect of the present invention, the drainage channel is inclined along an inner edge of the sump housing and communicates with the drainage pump.

The sump housing includes a pump motor receiving part to receive a pump motor to drive a washing impeller that pumps wash water, and the drainage channel includes first and second drainage channels formed around the pump motor receiving part and a third drainage channel connected between the first and second drainage channels, the third drainage channel communicating with the drainage pump.

The first and second drainage channels have surfaces inclined downward to the third drainage channel such that drainage is smoothly performed along the downward-inclined surfaces.

According to an aspect of the present invention, a bottom surface of the drainage channel is lower than a top surface of the pump motor receiving part.

According to an aspect of the present invention, the sump housing is formed in a shape of a container, the pump motor receiving part is disposed in a center of the sump housing, the drainage channel is disposed between the pump motor receiving part and a rim wall of the sump housing, and the drainage channel is located below a top surface of the pump motor receiving part and in a shape surrounding the pump motor receiving part.

The drainage channel includes a turbidity sensor to detect the turbidity of wash water mounted therein.

It is another aspect of the present invention to provide a dish washing machine including a sump to receive and pump wash water, a sump housing forming an external appearance of the sump, a drainage pump mounted at the sump housing to discharge wash water and dirt from the sump housing, and a drainage channel communicating with the drainage pump to guide wash water and dirt to the drainage pump, wherein the drainage channel extends along an inner edge of the sump housing.

The sump housing includes a pump motor receiving part to receive a pump motor to drive a washing impeller which pumps wash water, and the drainage channel includes first and second drainage channels surrounding an edge of the pump motor receiving part and a third drainage channel connected between the first and second drainage channels and communicating with the drainage pump, the first and second drainage channels having surfaces inclined downward to the third drainage channel such that drainage is smoothly performed along the downward-inclined surfaces.

The third drainage channel includes a drainage pump connection hole connected to the drainage pump.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
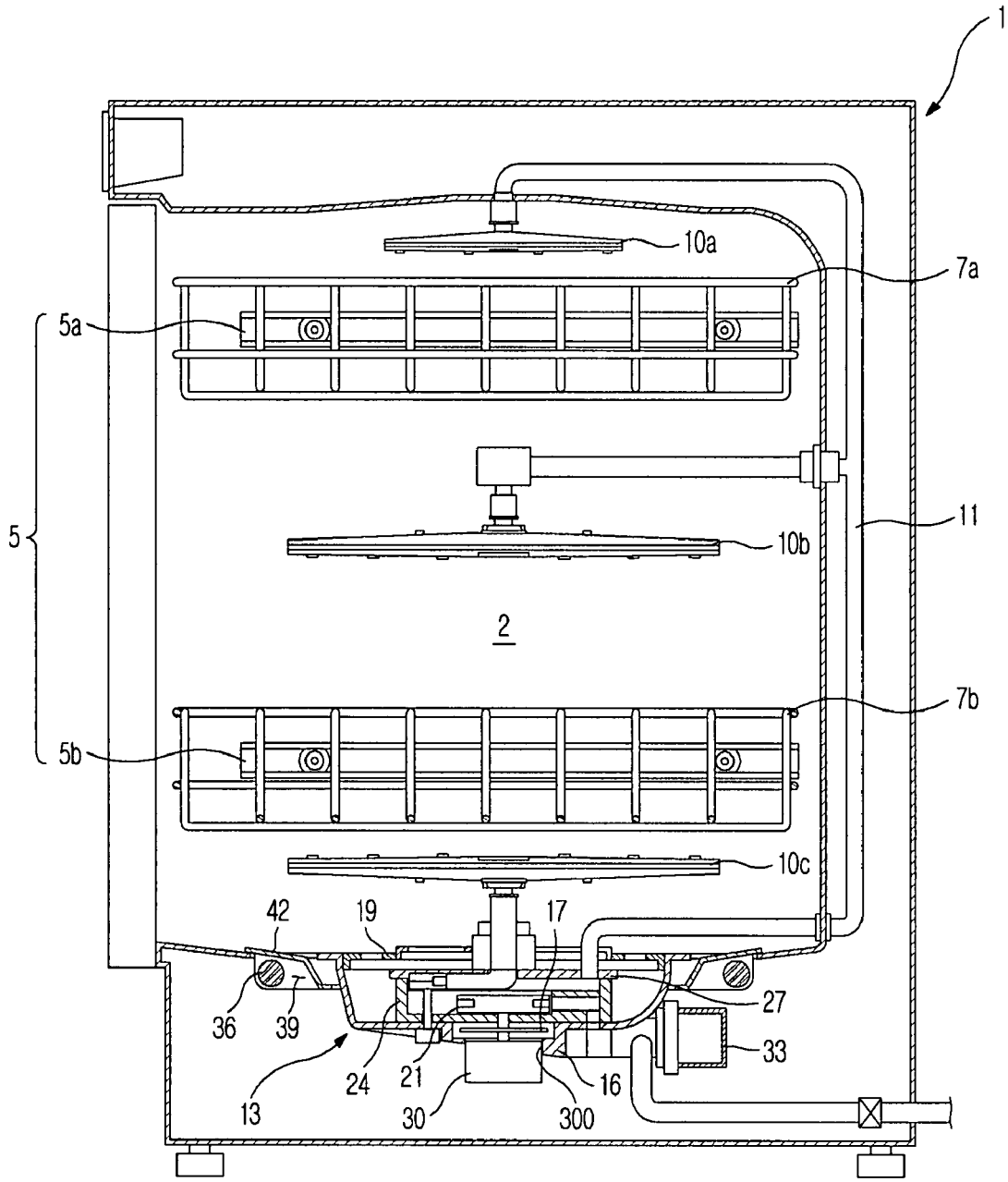
FIG. 1 is a side sectional view of a dish washing machine according to an embodiment of the present invention.

Reference will now be made in detail to the embodiments of the present invention, examples of which are illustrated in the accompanying drawings, wherein like reference numerals refer to like elements throughout. The embodiments are described below to explain the present invention by referring to the figures.

As shown in FIG. 1, the dish washing machine according to an embodiment of the present invention, comprises a machine body 1 forming an external appearance of the dish washing machine, a washing tub 2 disposed in the machine body 1, and a rack 5 fixed to a sidewall of the washing tub 2. The rack 5 comprises an upper rack 5*a* and a lower rack 5*b*, by which an upper basket 7*a* and a lower basket 7*b* are supported, respectively. Dishes are placed in the upper basket 7*a* and the lower basket 7*b*.

At the upper part, the middle part, and the lower part of the washing tub 2 are mounted main nozzles 10*a* and 10*b* and a sub nozzle 10*c*, respectively, to inject wash water. The wash water injected through the nozzles 10*a*, 10*b* and 10*c* is directed toward the baskets 7*a* and 7*b*. The nozzles 10*a*, 10*b* and 10*c* are rotated by the injection pressure of the wash water injected through the nozzles 10*a*, 10*b* and 10*c*. The wash water injected through the nozzles 10*a*, 10*b*, and 10*c* collides with the dishes in the baskets 7*a* and 7*b* to strongly wash the dishes.

A sump 13 is mounted at the bottom of the washing tub 2 to receive, pump, and supply wash water to the respective nozzles.

At the rear of the washing tub 2 is disposed a feeding pipe 11 to supply wash water to the main nozzles 10*a* and 10*b*. The lower end of the feeding pipe 11 is connected to the sump 13. Consequently, the wash water flows to the main nozzles 10*a* and 10*b* through the feeding pipe 11 due to strong pumping pressure of the sump 13.

The sub nozzle 10*c* is directly connected with an upper center part of the sump 13. Consequently, some of the wash water is injected through the sub nozzle 10*c* to wash dishes placed in the lower basket 7*b* adjacent to the sub nozzle 10*c*.

When the quantity of dishes is relatively small, the dishes may be placed only in the upper basket 7*a*, and wash water is injected only through the main nozzles 10*a* and 10*b* while the wash water is not injected through the sub nozzle 10*c*.

The sump 13 comprises a sump housing 16 forming an external appearance of the sump, a sump cover 19 to cover the sump housing 16, a washing impeller 21 disposed in the sump housing 16, an impeller casing 24 to which the washing impeller 21 is mounted, and an impeller casing cover 27 disposed on the impeller casing 24.

At a bottom of the sump housing 16 is mounted a pump motor 30 to drive the washing impeller 21. In addition, a pump motor receiving part 300 is disposed at the bottom of the sump housing 16 such that the pump motor 30 is received in the pump motor receiving part 300.

Around the pump motor receiving part 300 is disposed a drainage channel (to be described later), to guide wash water and dirt discharged from the sump housing 16.

A drainage pump 33 is mounted at a side of the sump housing 16 to discharge wash water and dirt in the sump 13 out of the dish washing machine.

A heater 36 is mounted at an edge of the sump 13 to heat wash water. A heater receiving groove 39 is formed at the bottom of the washing tub 2, and extends along an edge of the sump 13 such that the heater 36 is received in the heater receiving groove 39.

After the heater 36 is received in the heater receiving groove 39, the heater 36 is covered by a heater cover 42 to prevent the heater 36 from being exposed to the outside.

Figure 2:
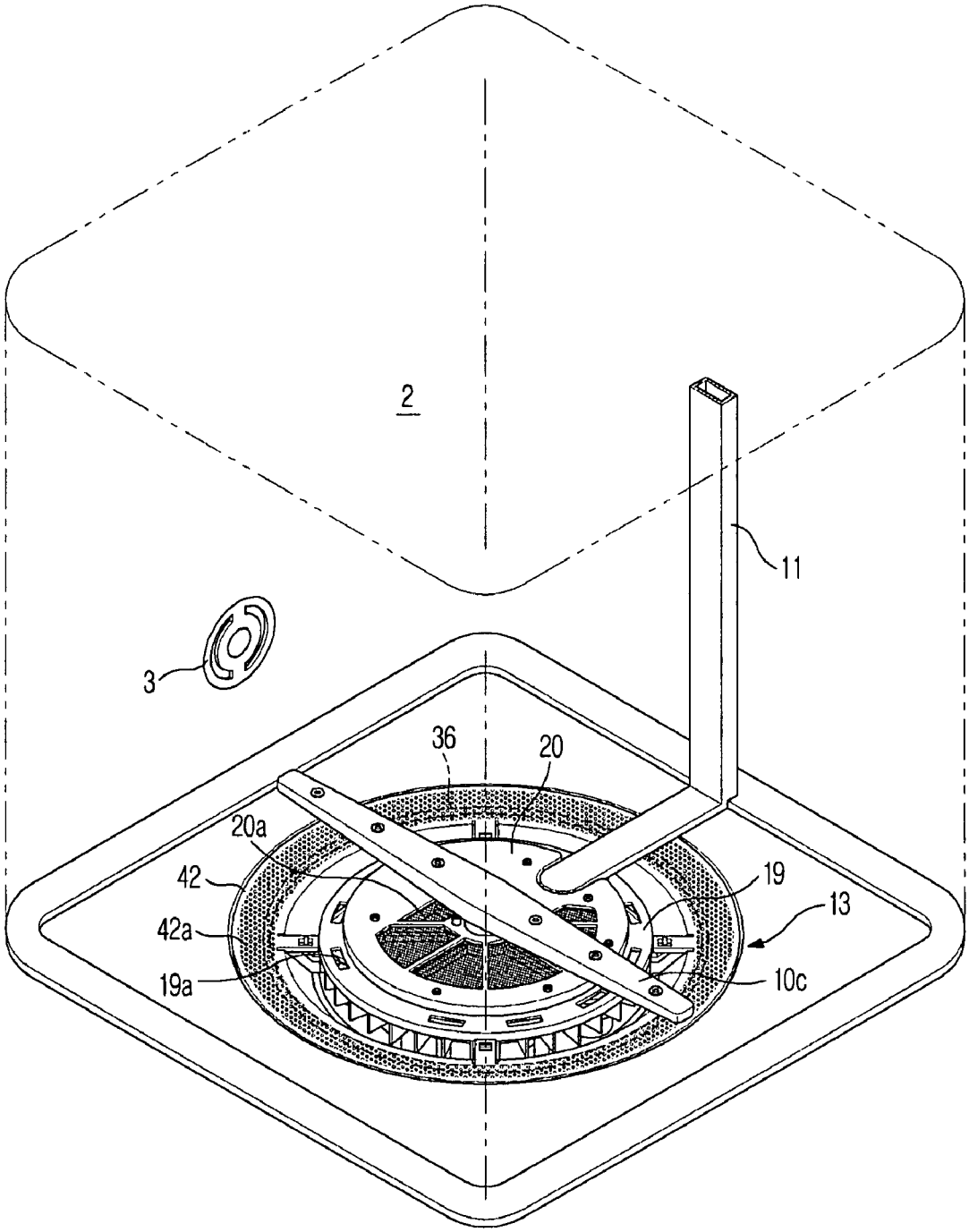
FIG. 2 is a perspective view illustrating an interior of a machine body of the dish washing machine according to an embodiment of the present invention.

As shown in FIG. 2, an inlet port 3 is formed through one side of the washing tub 2 such that wash water can be introduced into the washing tub 2 through the inlet port 3. Wash water introduced through the inlet port 3 falls to the bottom of the washing tub 2 and is introduced into the sump 13.

The sub nozzle 10*c* is rotatably coupled with a center of the sump 13. The feeding pipe 11 is connected with a rear end of the sump 13 such that wash water is guided to the main nozzles 10*a* and 10*b* through the feeding pipe 11.

The sump cover 19 is mounted on the sump 13. Inlet holes 19*a* are formed along an edge of the sump cover 19 and are arranged in regular intervals. Consequently, wash water is introduced into the sump 13 through the inlet holes 19*a*.

On the sump cover 19 is mounted a filter cover 20. A mesh filter 20*a* is mounted to the filter cover 20 to prevent dirt collected in a filth chamber (to be described later), from overflowing from the filth chamber and to allow only wash water to flow out of the filth chamber.

The heater 36 is mounted at the edge of the sump 13 in the shape of a ring, for example. The heater cover 42 is mounted on the heater 13. The heater cover 42 comprises a plurality of through-holes 42*a*, through which wash water flows to the heater 36. The wash water is heated by the heater 36, and is then introduced into the sump 13.

Figure 3:
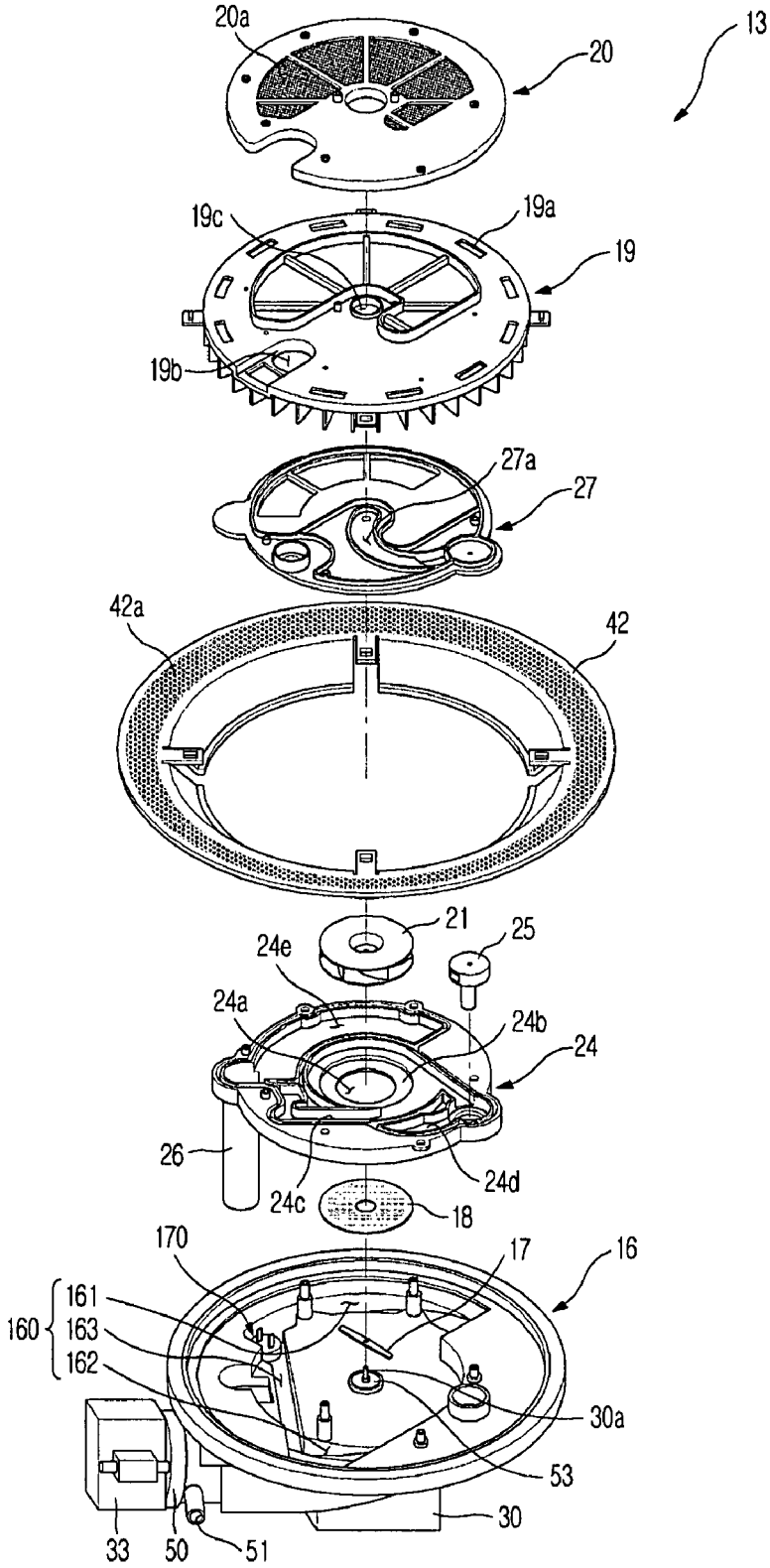
FIG. 3 is an exploded perspective view of a sump according to an embodiment of the present invention.

FIG. 3 illustrates the structure of the sump 13, according to an embodiment of the present invention. At one side of the sump housing 16 is disposed a pump fixing part 50, to which the drainage pump 33 is fixed. A drainage pipe 51 is connected to one side of the pump fixing part 50, through which wash water and dirt are discharged.

Figure 6:
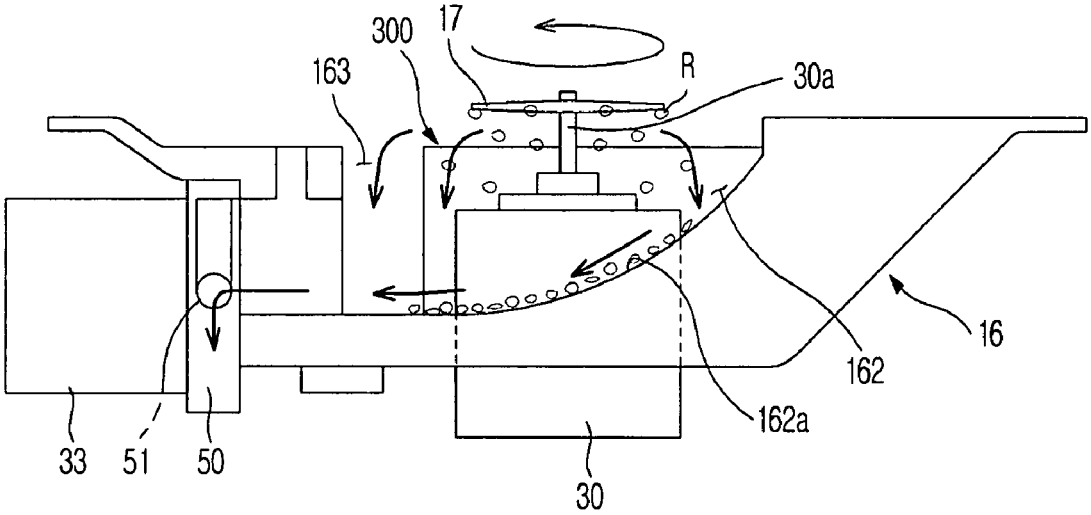
FIG. 6 is a sectional view taken along line II-II' of FIG. 4.

The pump motor 30 is mounted at a bottom of the sump housing 16, specifically, to the pump motor receiving part 300 (see FIG. 6). Around the pump motor receiving part 300 is disposed a drainage channel 160, which surrounds the pump motor receiving part 300.

A rotary shaft 30*a* of the pump motor 30 extends through the pump motor receiving part 300. At the pump motor receiving part 300 is disposed a sealing member 53, which surrounds the rotary shaft 30*a* to prevent wash water from leaking to the pump motor 30.

The impeller casing 24 is disposed on the sump housing 16. In a center of the impeller casing 24 comprises a communication hole 24*a*, which communicates with the sump housing 16. Around the communication hole 24*a* is disposed an impeller receiving part 24*b*, in which the washing impeller 21 is received.

The washing impeller 21 is coupled with the rotary shaft 30*a* of the pump motor 30 such that the washing impeller 21 is rotated to pump wash water introduced into the sump housing 16 upward. A filter 18 is provided to prevent large amounts of dirt from being flowed in the washing impeller 21.

The impeller casing 24 comprises a main channel 24*c* and a sub channel 24*d*, which diverge from the impeller receiving part 24*b*. The main channel 24*c* serves to guide wash water to the main nozzles 10*a* and 10*b* (see FIG. 1). The sub channel 24*d* serves to guide wash water to the sub nozzle 10*c* (see FIG. 1).

The main channel 24*c* serves as a primary channel to guide the flow of wash water in the sump 13. Consequently, wash water constantly passes along the main channel 24*c* during the washing operation of the dish washing machine.

Thus, the main channel 24*c* extends from the impeller receiving part 24*a* in a shape of a curve to prevent drop of the injection pressure of wash water flowing along the main channel 24*c*.

When the main channel 24*c* is sharply bent, wash water collides with the sharply bent part of the main channel 24*c* with the result that kinetic energy of the wash water is lost. Consequently, the main channel 24*c* is formed in the shape of a curve to minimize the loss of kinetic energy.

A channel control valve 25 is rotatably mounted in the sub channel 24*d* to intermit the flow of wash water to the sub channel 24*d*. When the quantity of dishes to be washed is small, the sub channel 24*d* is closed by the channel control valve 25 such that wash water can flow only to the main channel 24*c*.

Wash water flowing along the main channel 24*c* is injected through the main nozzles 10*a* and 10*b* (see FIG. 1) to wash dishes. Consequently, the amount of wash water used is reduced when the quantity of dishes to be washed is small.

A filth chamber 24*e* is formed beside the main channel 24*c* to collect dirt introduced into the main channel 24*c* together with wash water. Adjacent to an inlet of the filth chamber 24*e* is mounted a drainage connection pipe 26, which is connected with the drainage pump 33. When the drainage pump 33 is operated, dirt collected in the filth chamber 24*e* is discharged to the drainage pipe 51 through the drainage connection pipe 26.

According to an embodiment of the present invention, the main channel 24*c*, the sub channel 24*d*, and the filth chamber 24*e* are formed at the impeller casing 24.

The impeller casing cover 27 is disposed on the impeller casing 24. At the impeller casing cover 27 is formed a guide channel 27*a*, which communicates with the sub channel 24*d*. The guide channel 27*a* extends from the edge of the impeller casing cover 27 to a center of the impeller casing cover 27 in a shape of a curve.

Consequently, when the sub channel 24*d* is opened by the channel control valve 25, wash water pumped by the washing impeller 21 passes through the channel control valve 25, and flows along the sub channel 24*d*. At this time, the wash water is guided to the sub nozzle 10*c* (see FIG. 1) along the guide channel 27*a*, which communicates with the sub channel 24*d*, and is then injected through the sub nozzle 10*c*.

The sump cover 19 is disposed on the impeller casing cover 27. In the center of the sump cover 19 is formed an engaging hole 19*c*, in which the lower end of the sub nozzle 10*c* (see FIG. 1) is engaged. The inlet holes 19*a*, through which wash water is introduced, are formed along the edge of the sump cover 19 such that the inlet holes 19*a* are arranged in regular intervals.

In the sump cover 19 is formed a connection hole 19*b*, through which the feeding pipe 11 (see FIG. 2) extends to the main channel 24*c*.

The filter cover 20 is disposed on the sump cover 19. The mesh filter 20*a* is mounted to the filter cover 20. The mesh filter 20*a* covers an upper surface of the filth chamber 24*e* to prevent dirt collected in the filth chamber 24*e* from passing through the mesh filter 20*a* together with wash water.

Specifically, when dirt and wash water are introduced into the filth chamber 24*e*, the wash water passes through the mesh filter 20*a*. However, the dirt is filtered by the mesh filter 20*a* and is left in the filth chamber 24*e*.

The wash water separated from the dirt is introduced into the sump 13 through the inlet holes 19*a*, and is then continuously circulated through the above-described course.

The heater 36 (see FIG. 2) and the heater cover 42 are disposed at the edge of the sump 13 such that the heater 36 and the heater cover 42 surround the edge of the sump 13.

Figure 4:
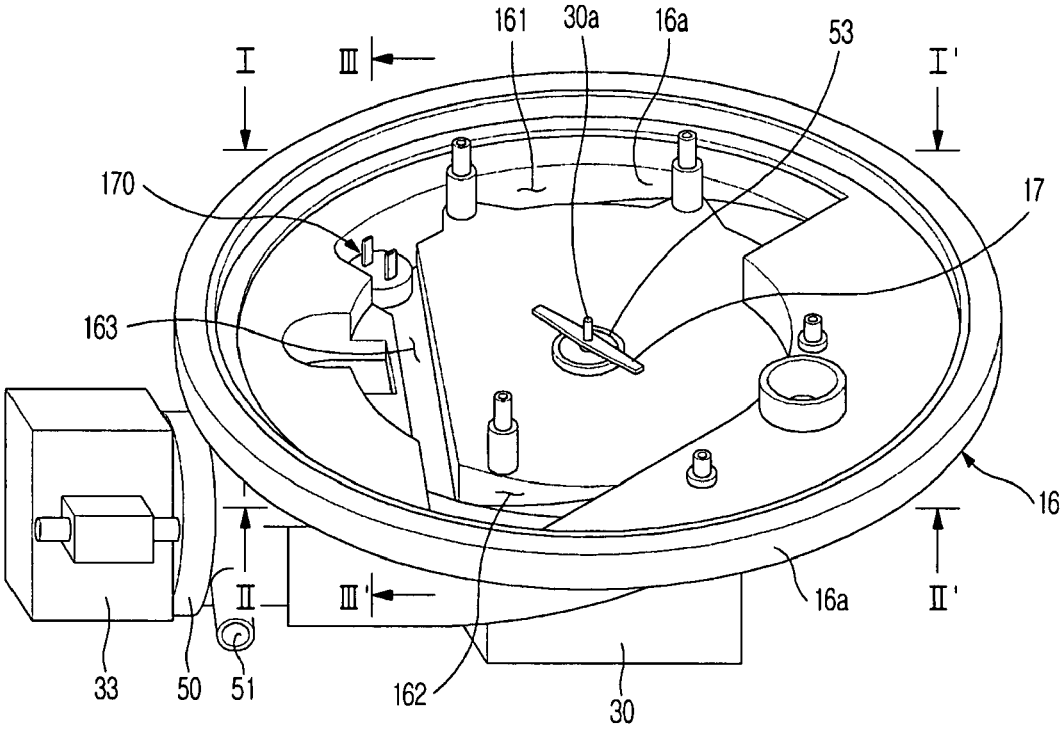
FIG. 4 is a perspective view of a drainage channel according to an embodiment of the present invention.

As shown in FIG. 4, the drainage channel comprises first and second drainage channels 161 and 162 formed around the pump motor receiving part 300 (see FIG. 6) and a third drainage channel 163 connected between the first and second drainage channels 161 and 162. The third drainage channel 163 communicates with the drainage pump 33.

Specifically, the first and second drainage channels 161 and 162 are disposed between the pump motor receiving part 300 and a rim wall 16*a* of the sump housing 16.

The bottom surfaces of the first and second drainage channels 161 and 162 are inclined downward to the third drainage channel 163.

The top surface of the pump motor receiving part 300 is located above the bottom surface of the drainage channel 160.

The rotary shaft 30*a* of the pump motor 30 extends through a top of the pump motor receiving part 300. To the rotary shaft 30*a* is mounted a cutter 17 to crush filth contained in wash water.

Between the first drainage channel 161 and the third drainage channel 163 is disposed a turbidity sensor 170 to detect the turbidity of wash water.

Hereinafter, the function of the drainage channel will be described with reference to FIGS. 5-7.

Figure 5:
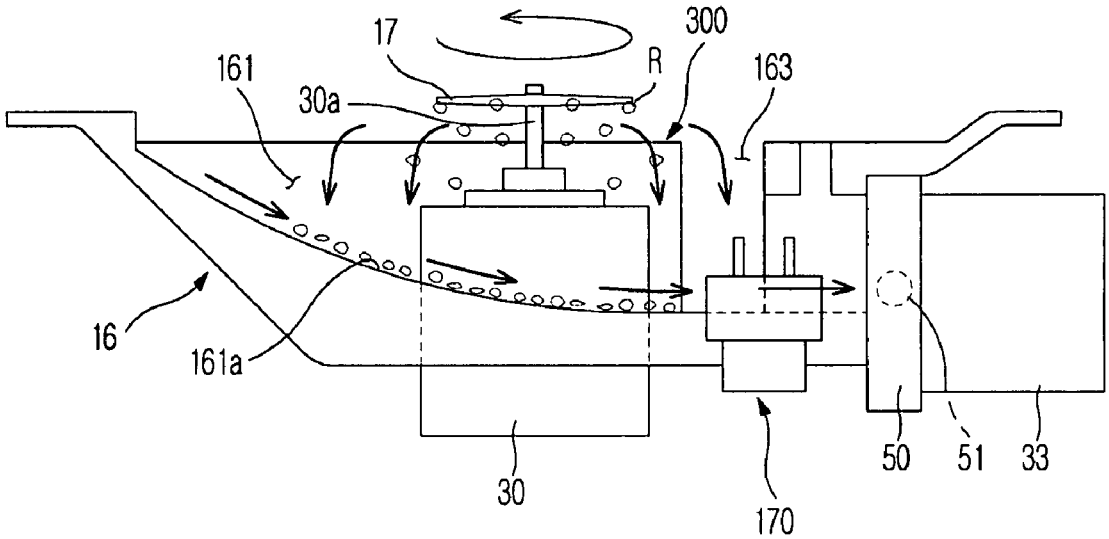
FIG. 5 is a sectional view taken along line I-I' of FIG. 4.

FIG. 5 is a sectional view taken along line I-I' of FIG. 4. In the case that dirt R is accumulated in the first drainage channel 161 while the dirt R is crushed by the cutter 17 or is not crushed, the dirt R is moved along the first drainage channel 161 and the third drainage channel 163, and is discharged through the drainage pipe 51 by an operation of the drainage pump 33.

At this time, the dirt R is easily moved toward the drainage pump 33 since the bottom surface 161*a* of the first drainage channel 161 is inclined downward to the third drainage channel 163.

FIG. 6 is a sectional view taken along line II-II' of FIG. 4. The second drainage channel 162 is opposite to the first drainage channel 161. The second drainage channel 162 also communicates with the third drainage channel 163.

Since a bottom surface 162*a* of the second drainage channel 162 is also inclined downward to the third drainage channel 163, dirt accumulated in the second drainage channel 162 is moved along the bottom surface 162*a*, is guided along the third drainage channel 163, and is then discharged through the drainage pipe 51 by the operation of the drainage pump 33.

Figure 7:
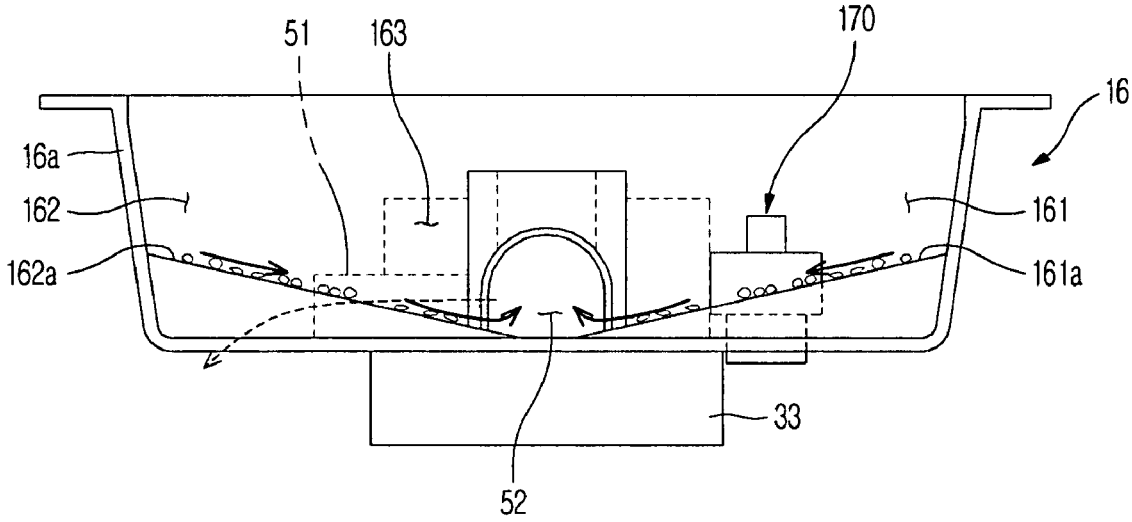
FIG. 7 is a sectional view taken along line III-III' of FIG. 4.

FIG. 7 is a sectional view taken along line III-III' of FIG. 4. The third drainage channel 163 is connected between the first drainage channel 161 and the second drainage channel 162.

The bottom surfaces 161*a* and 162*a* of the first and second drainage channels 161 and 162 are inclined downward to the third drainage channel 163.

In a center of the third drainage channel 163 is formed a drainage pump connection hole 52, which communicates with the drainage pump 33. When the drainage pump 33 is operated, dirt accumulated in the respective drainage channels 161, 162, and 163 passes through the drainage pump connection hole 52, and is then discharged through the drainage pipe 51.

Hereinafter, the operation of the sump will be described with reference to the accompanying drawings.

Figure 8:
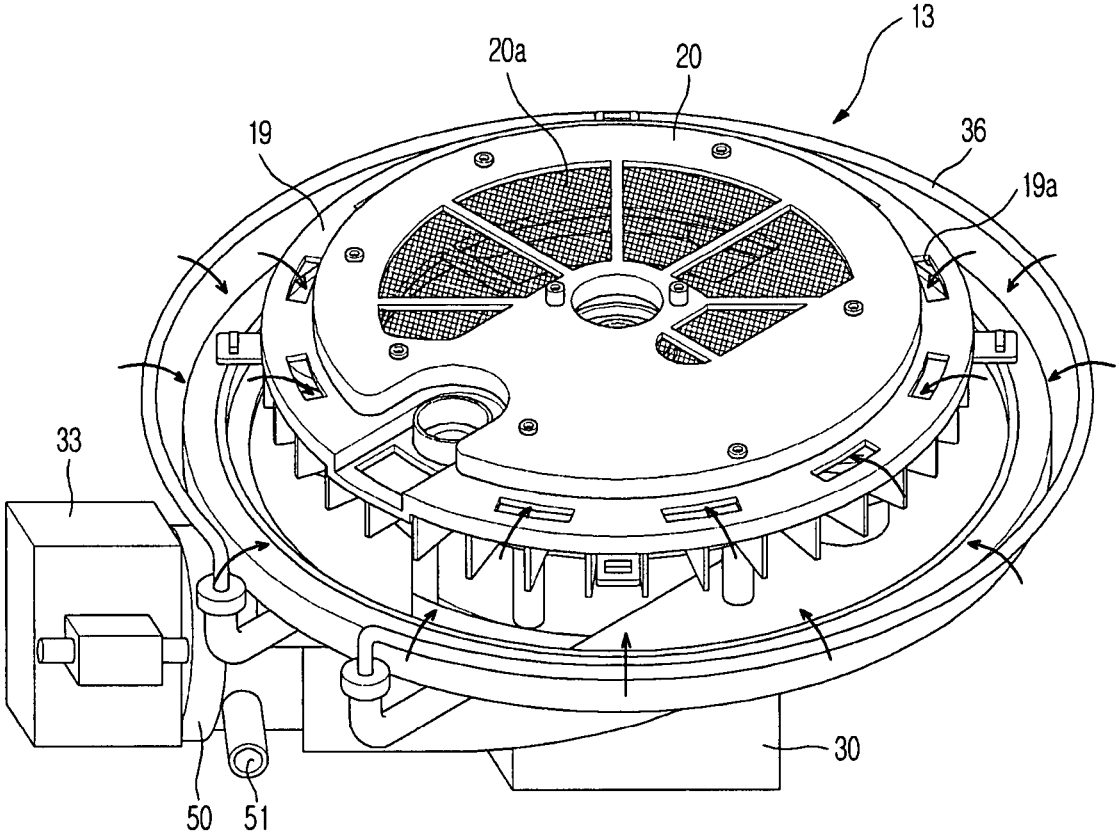
FIGS. 8 and 12 are assembled perspective views of the sump, according to an embodiment of the present invention.
Figure 9:
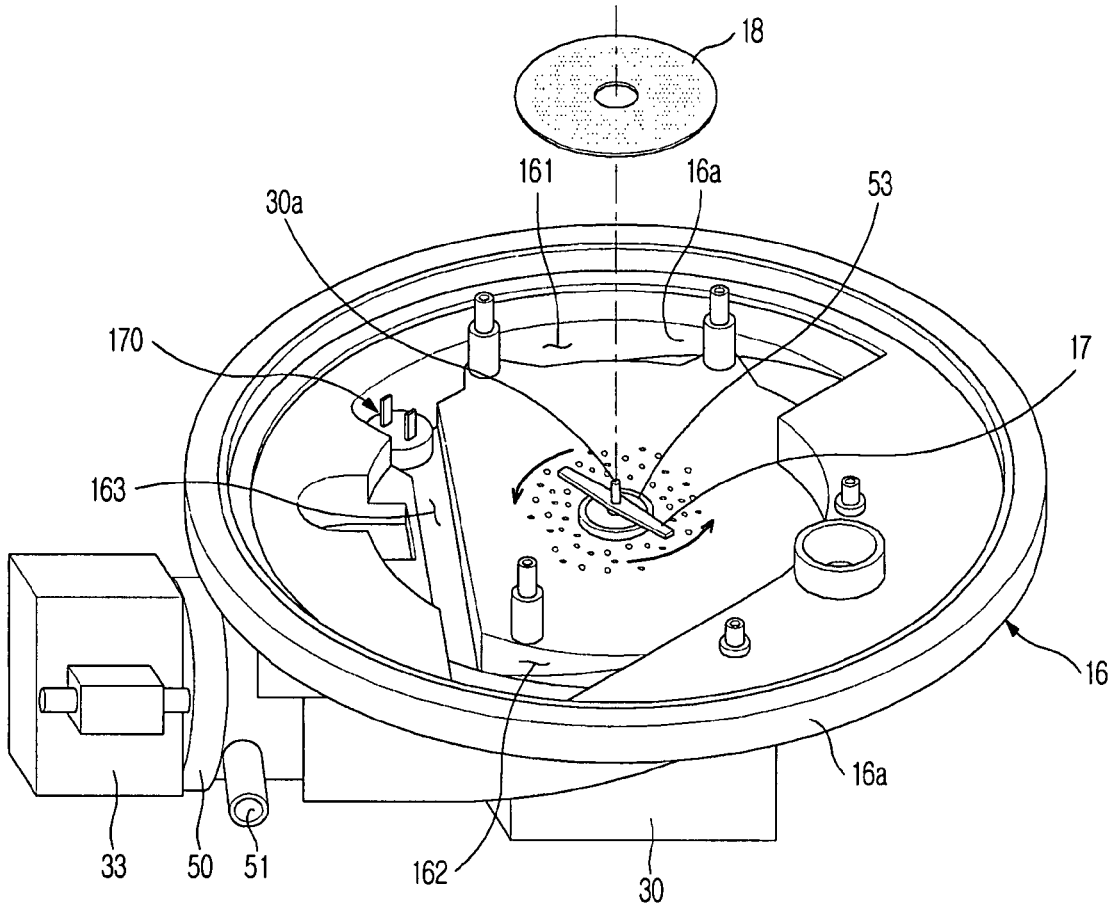
FIG. 9 is a perspective view of a sump housing according to an embodiment of the present invention.

As shown in FIG. 8, wash water is heated by the heater 36, and is then introduced into the sump 13. As shown in FIG. 9, dirt R introduced together with wash water is accumulated in the drainage channels 161, 162, and 163 while the dirt R is crushed by the cutter 17 or not crushed.

Figure 10:
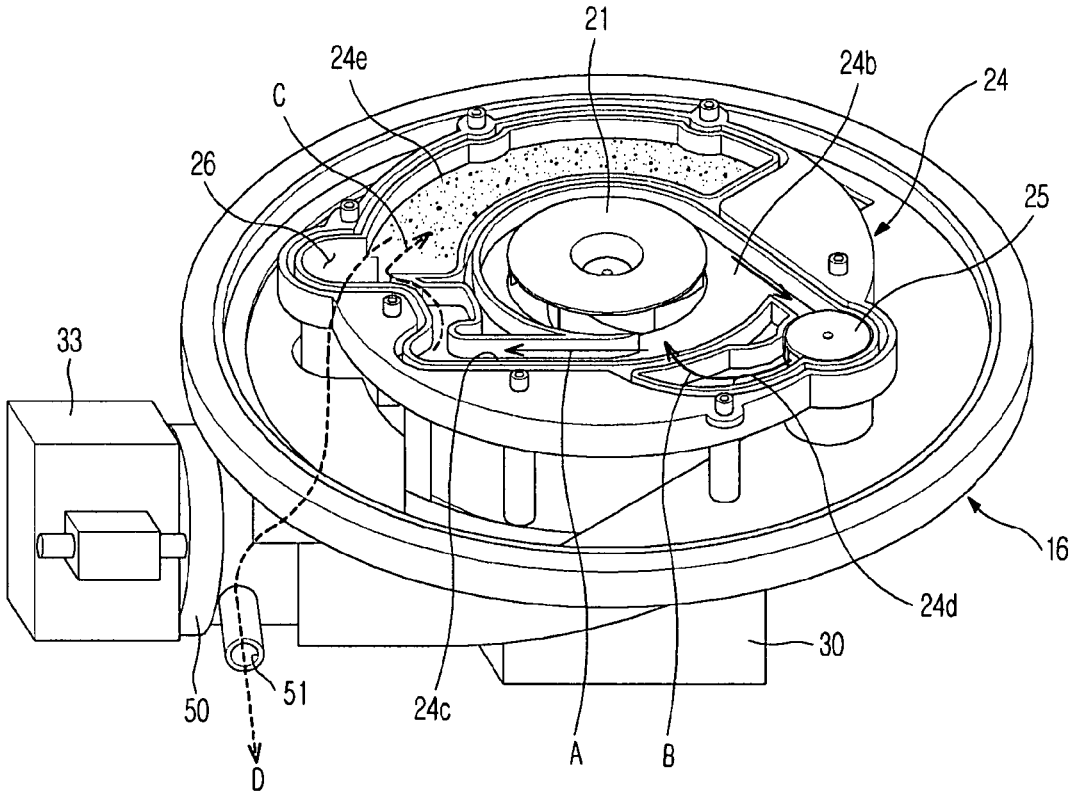
FIG. 10 is an assembled perspective view of the sump housing and an impeller casing according to an embodiment of the present invention.

As shown in FIG. 10, the wash water received in the sump housing 16 is pumped upward to the impeller casing 24 as the washing impeller 21 mounted to the rotary shaft 30*a* is rotated.

The pumped wash water is moved from the impeller receiving part 24*b* to the main channel 24*c* (in the direction indicated by arrow 'A') and the sub channel 24*d* (in the direction indicated by arrow 'B') due to the rotating force of the washing impeller 21. When the sub channel 24*d* is closed by the channel control valve 25, the wash water is moved only to the main channel 24*c*.

The wash water flowing along the main channel 24*c* in the direction indicated by arrow 'A' is raised through the feeding pipe 11 (see FIG. 2), due to a strong pressure of the washing impeller 21, and then reaches the main nozzles 10*a* and 10*b* (see FIG. 1).

When the quantity of dishes to be washed is small, and therefore, it is necessary to operate only the main nozzles 10*a* and 10*b* (see FIG. 1), the sub channel 24*d* is closed by the channel control valve 25. As a result, wash water flows along only the main channel 24*c*. The wash water flowing along the main channel 24*c* reaches the main nozzles 10*a* and 10*b* through the feeding pipe 11, and is then injected through the main nozzles 10*a* and 10*b*.

When the quantity of dishes to be washed is large, and therefore, it is necessary to operate the sub nozzle 10*c* (see FIG. 1) as well as the main nozzles 10*a* and 10*b*, the sub channel 24*d* is opened by the channel control valve 25. As a result, wash water flows in the direction indicated by arrow 'B'. Subsequently, the wash water reaches the sub nozzle 10*c*, and is then injected through the sub nozzle 10*c*.

The filth chamber 24*e* is connected to the main channel 24*c*. Consequently, dirt mixed with some wash water is moved (in the direction indicated by arrow 'C'), and is then collected in the filth chamber 24*e*.

The drainage connection pipe 26 connected with the drainage pump 33 is adjacent to an inlet of the filth chamber 24*e*. Consequently, the dirt collected in the filth chamber 24*e* is discharged to the outside (in the direction indicated by arrow 'D') during the operation of the drainage pump 33.

When the drainage pump 33 is operated, not only the dirt accumulated in the filth chamber 24*e* but also the dirt accumulated in the drainage channels 161, 162, and 163 (see FIG. 9) are discharged to the outside together with contaminated wash water.

Figure 11:
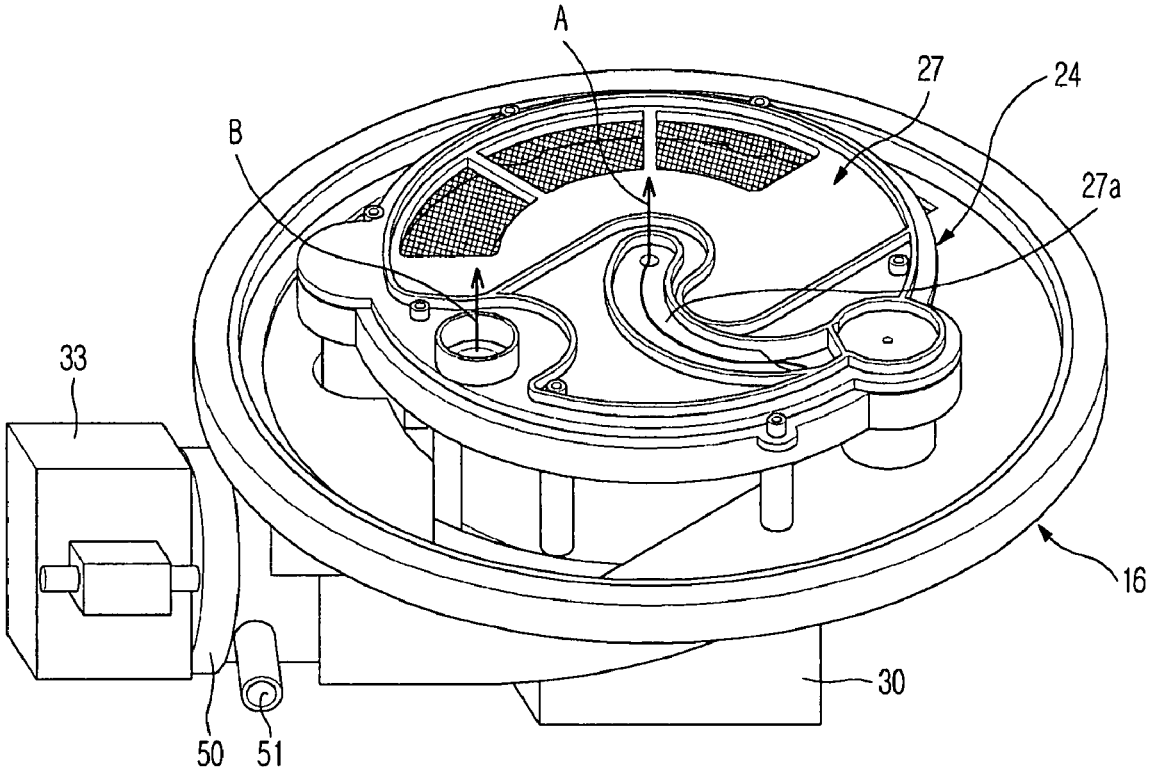
FIG. 11 is a perspective view illustrating an impeller casing cover coupled to the sump housing, according to an embodiment of the present invention.

As shown in FIG. 11, the guide channel 27*a* is formed at the impeller casing cover 27 disposed on the impeller casing 24 such that the guide channel 27*a* communicates with the sub channel 24*d* (see FIG. 10)

When the washing impeller 21 (see FIG. 10) is operated in the state that the sub channel 24*d* is opened by the channel control valve 25 (see FIG. 10), wash water also flows along the sub channel 24*d*. The wash water flowing along the sub channel 24*d* is guided to a center of the impeller casing cover 27 along the guide channel 27*a*, is moved to the sub nozzle 10*c* (see FIG. 1) in the direction indicated by arrow 'A', and is injected through the sub nozzle 10*c*.

Arrow 'B' indicates the flow direction of the wash water flowing to the main nozzles 10*a* and 10*b* (see FIG. 1).

Figure 12:
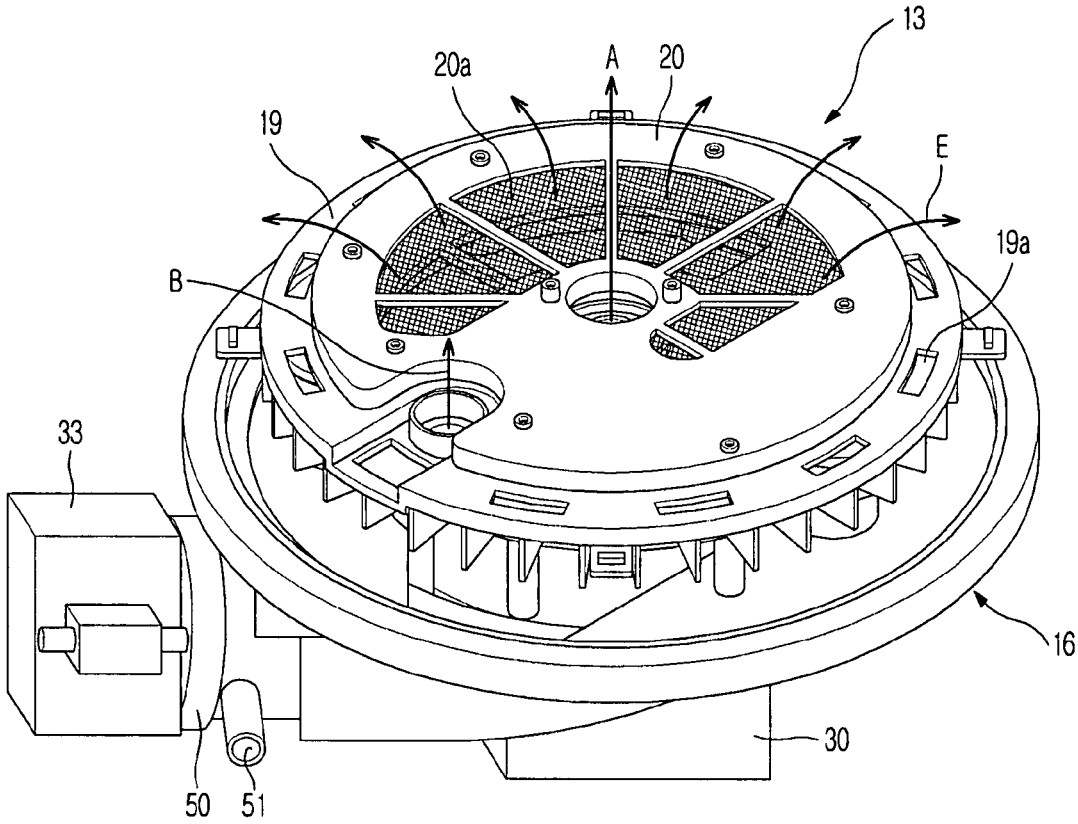

As shown in FIG. 12, wash water and dirt introduced into the filth chamber 24*e* (see FIG. 10) along the main channel 24*c* (see FIG. 10) are pushed toward the mesh filter 20*a* due to the pressure of subsequent wash water. However, the dirt does not pass through the mesh filter 20*a*. Consequently, the dirt is left in the filth chamber 24*e* (see FIG. 10). Only the wash water passes through the mesh filter 20*a* in the direction indicated by arrow 'E', and is then discharged out of the sump 13.

The discharged wash water is reintroduced into the sump 13, and flows inside the sump 13 to perform the washing operation as previously described.

According to an embodiment of the present invention, the drainage channels are formed in the sump housing, and some of the drainage channels are constructed such that the bottom surfaces of the drainage channels are inclined. As a result, it is possible to rapidly discharge filth contained in wash water out of the sump during the drainage of the wash water.

Consequently, the present invention has the effect of preventing the emission of bad smells from filth and preventing the propagation of bacteria.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A dish washing machine, comprising:

a sump to receive and pump wash water;

a sump housing forming an external appearance of the sump and comprising a pump motor receiving part to receive an upper portion of a pump motor to drive a washing impeller that pumps wash water;

a drainage pump coupled with the sump housing to discharge wash water and dirt; and a drainage channel disposed in the sump housing to guide wash water and dirt to the drainage pump and including a reception drainage channel communicating with the drainage pump and at least one first drainage channel formed around the pump motor receiving part, wherein a bottom surface of the drainage channel is lower than a top surface of the pump motor receiving part.

2. The dish washing machine according to claim 1, wherein the drainage channel is inclined along an inner edge of the sump housing and communicates with the drainage pump.

3. The dish washing machine according to claim 1, wherein the at least one first drainage channel comprises first and second drainage channels formed around the pump motor receiving part, the reception drainage channel being connected between the first and second drainage channels.

4. The dish washing machine according to claim 3, wherein the sump housing is formed in a shape of a container, the pump motor receiving part is disposed in a center of the sump housing, the drainage channel is disposed between the pump motor receiving part and a rim wall of the sump housing, and the drainage channel is located below the top surface of the pump motor receiving part in a shape surrounding the pump motor receiving part.

5. The dish washing machine according to claim 3, wherein the drainage channel comprises a turbidity sensor to detect the turbidity of wash water.

6. A dish washing machine, comprising:

a sump to receive and pump wash water;

a sump housing forming an external appearance of the sump, the sump housing including a pump motor receiving part to receive an upper portion of a pump motor to drive a washing impeller that pumps wash water;

a drainage pump mounted at the sump housing to discharge wash water and dirt from the sump housing; and a drainage channel communicating with the drainage pump to guide wash water and dirt to the drainage pump, the drainage channel extending along an inner edge of the sump housing and including a reception drainage channel communicating with the drainage pump and at least one first drainage channel formed around the pump motor receiving part, wherein a bottom surface of the drainage channel is lower than a top surface of the pump motor receiving part.

7. The dish washing machine according to claim 6, wherein the at least one first drainage channel comprises first and second drainage channels surrounding an edge of the pump motor receiving part, the reception drainage channel being connected between the first and second drainage channels.

8. The dish washing machine according to claim 7, wherein the reception drainage channel comprises a drainage pump connection hole connected with the drainage pump wherein dirt accumulated in the respective drainage channels passes through the drainage pump connection hole, and is then discharged through a drainage pipe.

* * * * *

UNITED STATES PATENT AND TRADEMARK OFFICE

CERTIFICATE OF CORRECTION

PATENT NO. : 7,946,304 B2
APPLICATION NO. : 11/806519
DATED : May 24, 2011
INVENTOR(S) : Eui Soo Kim et al.

It is certified that error appears in the above-identified patent and that said Letters Patent is hereby corrected as shown below:

On the Title Page, Item (75)

(Inventors), Line 1, Delete "Suweon-si" and insert -- Suwon-si --, therefor.

(Inventors), Line 3, Delete "Seognam-si" and insert -- Seongnam-si --, therefor.

(Inventors), Line 5, Delete "Suweon-si" and insert -- Suwon-si --, therefor.

Signed and Sealed this
Twenty-first Day of February, 2012

David J. Kappos

David J. Kappos
*Director of the United States Patent and Trademark Office*